US006970662B2

(12) United States Patent
Shi et al.

(10) Patent No.: US 6,970,662 B2
(45) Date of Patent: Nov. 29, 2005

(54) SYSTEMS AND METHODS FOR IN SITU SETTING CHARGE VOLTAGES IN A DUAL RECHARGE SYSTEM

(75) Inventors: Fan Shi, Penfield, NY (US); John M. Scharr, Canandaigua, NY (US); Mark A. Scheuer, Williamson, NY (US); Patricia J. Donaldson, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 99 days.

(21) Appl. No.: 10/707,576

(22) Filed: Dec. 22, 2003

(65) Prior Publication Data

US 2005/0135824 A1 Jun. 23, 2005

(51) Int. Cl.[7] ..... G03G 15/02
(52) U.S. Cl. ..... 399/50
(58) Field of Search ..... 399/38, 50, 130, 399/168, 169, 115

(56) References Cited

U.S. PATENT DOCUMENTS 5,537,198 A * 7/1996 Jackson ..... 399/168
5,600,430 A 2/1997 Folkins et al.
5,991,579 A * 11/1999 Yu ..... 399/170

* cited by examiner

*Primary Examiner*—Hoan Tran
(74) *Attorney, Agent, or Firm*—Oliff & Berridge, PLC

(57) ABSTRACT

Systems and methods for measuring and setting grid voltages in an image forming device may include setting a first charging device of a first image forming station to a first voltage level and setting a second charging device of the first image forming station to be off; charging a charge-retentive surface with the first charging device set at the first voltage level; measuring and the charge imparted to the charge-retentive surface by the first charging device; storing the measured charge value. Systems and methods may further include repeating the setting, charging, measuring and storing steps for the first charging device for at least one additional voltage level; and determining at least one parameter of the first charging device based on the stored measured charge values for the first charging device for each voltage level.

38 Claims, 6 Drawing Sheets

SYSTEMS AND METHODS FOR IN SITU SETTING CHARGE VOLTAGES IN A DUAL RECHARGE SYSTEM

BACKGROUND OF INVENTION

1. Field of Invention

This invention relates generally to a dual charging system of an image forming device.

2. Description of Related Art

One method of printing in multiple colors with a color copier, a color digital copier or a color laser printer is to uniformly charge a charge-retentive surface, such as a photoreceptor belt, and subsequently expose portions of the surface to define information to be reproduced in a first color. This information is rendered visible using chargeable toner particles. The charge-retentive surface is then recharged to a uniform potential and subsequently exposed and developed either at the same image forming station or the next image forming station, if more than one station is used, to form additional color layers.

This recharge, expose and develop (REaD) process is repeated to subsequently develop images of different colors to be superimposed on the surface of the charge-retentive surface before the full color image is transferred to a support substrate, such as paper. The different colors are developed on the charge-retentive surface in an image-on-image (IOI) process. Each different image may be formed by using a single exposure device, where each subsequent color image is formed in a subsequent pass of the charge-retentive surface. Alternatively, each different color image may be formed by multiple exposure devices corresponding to each different color image during a single pass of the charge-retentive surface.

Several issues arise that are unique to the REaD image-on-image process for creating multi-color images when attempting to provide optimum conditions for the development of subsequent color images onto previously-developed color images. For example, during a recharge step, it is important to level the voltages among previously toned and un-toned areas of the charge-retentive surface so that subsequent exposure and development steps are performed across a uniformly charged surface. The greater the difference in voltage between those image areas of the charge-retentive surface previously subjected to a development and recharge step, and those bare non-developed or un-toned areas of the charge-retentive surface, the larger the difference in the development potential can be between these areas for the subsequent development of image layers on the previous layers.

Another issue that must be addressed with the REaD image-on-image color image formation process is the residual charge and the resultant voltage drop that exists across the toner layer of a previously-developed area of the charge-retentive surface. Although it may be possible to achieve a uniform voltage by recharging the previously-toned layer to the same voltage level as the neighboring bare areas, the associated residual toner voltage prevents the effective voltage above any previously-developed toned areas from being re-exposed and discharged to the same level as neighboring bare photoreceptor areas which have been exposed and discharged to the actual desired voltage levels. Furthermore, the residual voltage associated with previously-developed toner images reduces the dielectric and effective development field in the toned areas, which tends to hinder attempts to achieve a desired uniform consistency of the developed mass of subsequent toner images.

These problems become increasingly severe as additional color images are subsequently exposed and developed on the charge retentive surface. Color quality of the final reproduced image is severely threatened by the presence of the toner charge and the resultant voltage drop across the toner layer. The change in voltage due to the toned image can be responsible for color shifts, increased moire, increased color shift sensitivity to image misregistration, and toner spreading at the image edges, thus affecting many of the imaging subsystems. Therefore, it is desirable to reduce, or ideally, eliminate, the residual toner voltage of any previously developed toned images and ensure that the potential difference across each toner layer is consistent and ideally minimum.

One way to improve the consistency of charge levels between the bare charge-retentive surface and previously toned areas is to use a dual recharge system, otherwise known as a split recharge system. In a dual recharge system, an AC charging device is coupled with a DC charging device to apply a charge to the charge-retentive surface. The DC and AC charging devices are set to given charge levels that cause the charge-retentive surface to be charged to a corresponding level. Precision adjustments can be made using the AC charging device. However, the ability of charging devices to consistently charge the charge-retentive surface is difficult to determine because it is at least partially dependent upon machine-specific characteristics, including characteristics of the charging devices themselves, and because these parameters vary with time and use of the image forming machine.

Because both charging devices are running during the image forming process, it is also impossible to isolate and measure the charge on the charge-retentive surface resulting from the DC charging device, since the charge resulting from the DC charging device is masked by the charge resulting from the AC charging device. Moreover, the ability of the DC charging device to charge the charge-retentive surface is based on physical parameters within the charging device, such as spacing to the charge-retentive surface and contamination levels, and is characterized by a linear relationship between the applied grid voltage and the charge-retentive surface charge level measured by the voltage sensing device.

SUMMARY OF INVENTION

This invention provides in situ DC grid voltage measuring systems and methods for an image forming device.

This invention separately provides systems and methods for calibrating DC voltage levels for achieving improved color transfer in a color image forming device.

This invention separately provides systems and methods for determining a useful machine-specific DC grid voltage.

This invention separately provides systems and methods for in-situ DC voltage measurement in a dual charging AC/DC system.

This invention separately provides systems and methods that determine the DC slope and offset of a DC charging device.

This invention separately provides systems and methods that determine the desired DC grid voltage for a DC charging device.

In various exemplary embodiments of the systems and methods according to this invention, the AC and DC charge voltages for charging a charge-retentive surface of a multicolor image forming device are set based on in-situ measurements of the relationship between the grid voltage of a DC charging device and the resulting charge level measured on the charge-retentive surface in a dual charging multicolor image-on-image-type image reproducing system. In various exemplary embodiments, a dual charging system employed in the image reproducing device comprises at least one AC and DC charging device pair. In various exemplary embodiments, one or more non-contact voltage sensing devices are used to measure the actual charge levels of the charge-retentive surface. It should be appreciated that various systems and embodiments according to this invention may be used with a dual charging system that includes one or more AC/AC charging device pairs or DC/DC charging device pairs, as well as AC/DC charging device pairs.

In various exemplary embodiments, an in-situ diagnostic routine is performed by the controller at predetermined intervals with the at least one AC charge device turned off. In various exemplary embodiments, the diagnostic routine takes measurements of the voltage level on the charge-retentive surface using the voltage sensing device at one or more grid voltage levels of the at least one DC charging device and determines the DC slope and DC offset voltage of the at least one DC charging device. In various exemplary embodiments, the diagnostic routine is performed in response to a request initiated by an operator of the imaging forming device. In various other exemplary embodiments, the diagnostic routine is performed in response to a request by a process control input.

In various exemplary embodiments, at run time, stored information is used, along with other process dependent variables, to determine the DC grid voltage level for each DC charging device.

In various exemplary embodiments, to determine the DC grid voltage, the charge-retentive surface passes through one or more image forming stations of a multicolor image forming device. The DC charging device of a first image forming station charges an electrically neutral charge-retentive surface to approximately a first charge level. The charge level is read by a charge sensing device at the first image forming station. In various exemplary embodiments, the charge sensing device is a non-contact electrostatic voltmeter. The charge level read by the charge sensing device is stored in memory.

In various exemplary embodiments, an exposure device exposes a portion of the charged charge-retentive surface to discharge that portion relative to the surrounding portions of the charge-retentive surface. The charge retentive surface passes to a next image forming station, where a next DC charging device recharges the charge-retentive surface to approximately the first uniform charge level. A voltage sensing device at the current image forming station senses the charge level of the charge-retentive surface at the location that was previously exposed and discharged. The charge level read by the voltage sensing device is stored in memory. This is repeated for each subsequent image forming station.

In various exemplary embodiments, this process is repeated for multiple DC grid voltage test levels until a plurality of charge level readings have been obtained for each DC charging device at different charge levels. The readings are used to determine the specific DC voltage characteristics of each DC charging device to obtain an improved DC operating grid voltage for each DC charging device. In various exemplary embodiments, a linear fit, such as a linear least squares fit, is used to calculate the DC slope and DC offset of each DC charging device.

In various exemplary embodiments, the results obtained by the diagnostic routine are combined with runtime inputs to determine the DC grid voltage charge level during runtime. In various exemplary embodiments, at runtime, the charge sensing devices read the charge level on the charge-retentive surface so that the actual levels can be compared to the target levels and the AC charge devices can be adjusted to achieve the target level. In various exemplary embodiments, the non-contact voltage sensing device samples the charge levels on the charge-retentive surface in the inter-page zone between successive prints with both the AC and DC charge devices running at their nominal set points. Differences between the sensing device readings and the control target voltages are be used to adjust the AC charge device via a control algorithm stored in a controller.

These and other features advantages of this invention are described in, or are apparent from, the following detail description of various exemplary embodiments of the systems and methods according to this invention.

BRIEF DESCRIPTION OF DRAWINGS

Various exemplary embodiments of the systems and methods of this invention will be described in detailed, with reference to the following figures, wherein.

DETAILED DESCRIPTION OF EXEMPLARY EMBODIMENTS

The following detailed description of exemplary embodiments of the systems and methods for in situ measuring and setting of the DC grid voltage levels in a split recharge system may refer to one specific type of image forming apparatus, a color laser image forming apparatus, for sake of clarity and familiarity. However, it should be understood, that the systems and methods according to this invention can be used with any image forming apparatus that uses a split recharge system. It should also be understood that, while this detailed description refers to setting DC grid voltages in a split recharge system that has a DC and AC charging device pair, various exemplary embodiments of the systems and methods according to this invention could be used in any split recharge system that uses at least one pair of charging devices to charge the charge-retentive surface. For example, various exemplary embodiments of the systems and methods according to this invention could be used in a system which has a DC/DC charging device pair, or an AC/AC charging device pair, instead of, or in addition to, an AC/DC charging device pair. Various exemplary embodiments of the systems and methods according to this invention are useful with any split recharge system where it is necessary to isolate one of the charging devices to ascertain the charging device characteristics of that charging device in order to maintain precise charging of the charge-retentive surface.

Figure 1:
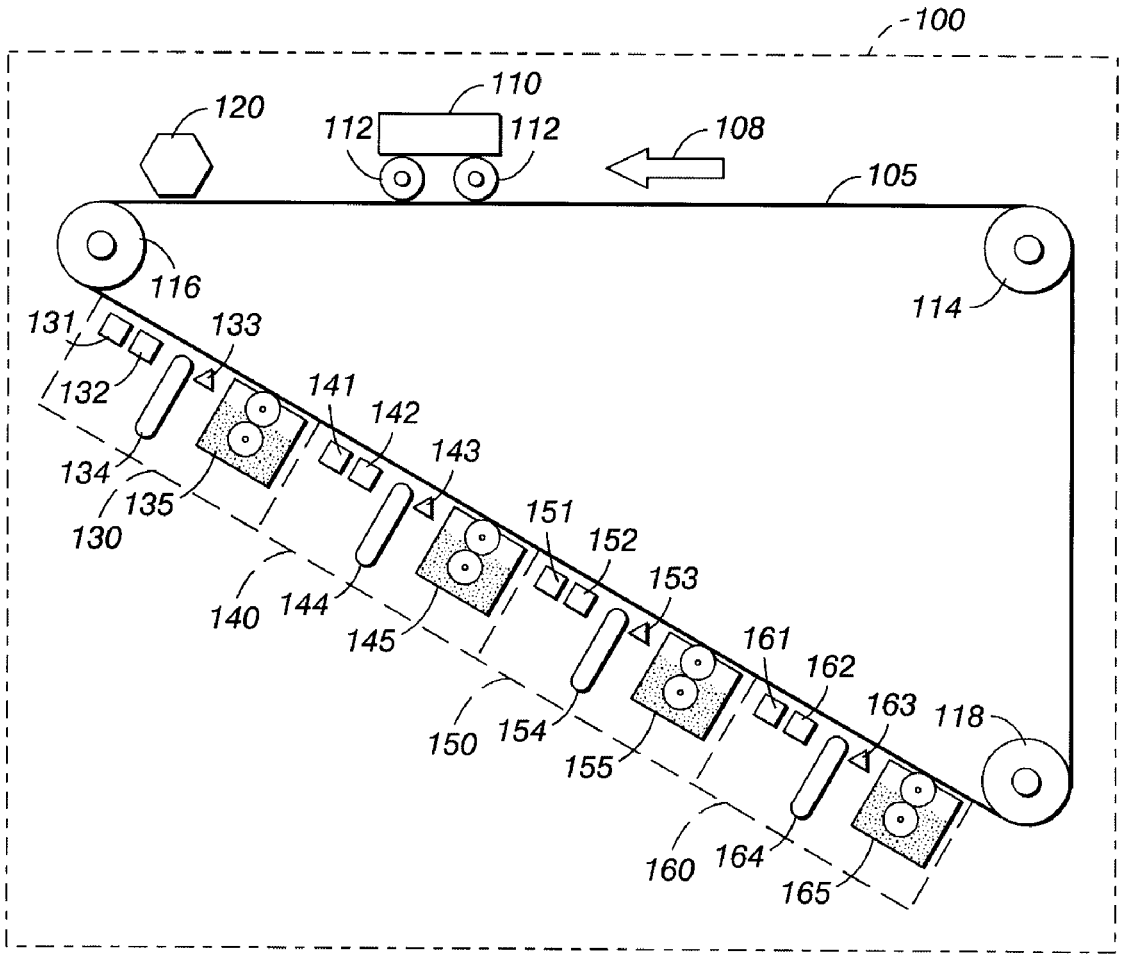
FIG. 1 illustrates an exemplary four-color image transfer device usable with various exemplary embodiments of the systems and methods of this invention.

FIG. 1 illustrates one exemplary embodiment of a laser color image forming apparatus 100 which uses a charge-retentive surface 105. In various exemplary embodiments, the charge-retentive surface 105 is a photoreceptor belt that is supported by rollers 114, 116 and 118. The charge-retentive surface travels in the direction indicated by the arrow 108 over and around the rollers 114, 116 and 118. The charge-retentive surface 105 is advanced by driving a pair of contact rollers 112 using a motor 110. The charge-retentive surface 105 is advanced past various different image forming stations 130, 140, 150 and 160. In various exemplary embodiments, each image forming station applies one color of charged toner to the charge-retentive surface. In various exemplary embodiments, there are four colors of toner used to create a full color image comprising the colors cyan, magenta, yellow and black.

In operation, the charge-retentive surface 105 travels to a discharging station 120 that places the charge-retentive surface 105 at a residual charge state. That is, the discharging device 120 neutralizes the charge on the photoreceptor belt 105 to a residual level. The charge-retentive surface 105 is then transported past a first image forming station, or first color station, 130. DC and AC charge grid voltage devices 131 and 132 of the first image forming station 130 charge the charge-retentive surface of the belt 105 to a relatively high and, ideally, a substantially uniform, potential. In various exemplary embodiments, the charge-retentive surface 105 is negatively charged. However, it should be understood that the systems and methods according to this invention could be used with a positively-charged charge-retentive surface.

Next, an exposure device 134 of the first image forming station 130 selectively discharges areas of the charge-retentive surface 105 corresponding to the image area for the toner color developed using the first image forming station 130. In various exemplary embodiments, the exposure device 134 is a raster output scanner (ROS) or other laser-based output scanning device. The charge-retentive surface 105 then proceeds to the developer device 135 of the first image forming station 130. In various exemplary embodiments, the developer device 135 contains charged toner and one or more insulative magnetic brushes that contact the latent electrostatic image formed on the charge-retentive surface 105 to deposit negatively charged toner material on the exposed portions of the charge-retentive surface 105 containing the latent electrostatic image. However, any developer device and developing technique could be used.

The charge-retentive surface 105 next advances to a second image forming station 140. The second image forming station 140 includes DC and AC charging devices 141 and 142 that re-apply a uniform charge to the charge-retentive surface 105 to recharge the charge-retentive surface 105 to the relatively high, and ideally, substantially uniform potential. The raster output scanner, or other exposure device, 144 re-exposes those portions of the charge-retentive surface 105 on which the next color toner is to be deposited. The next color toner is then applied by a developer station 145 to develop the latent electrostatic image. The process continues until the remaining image forming stations 150 and 160 have been passed. After toner from the developer stations 155 and 165 have been deposited on the charge-retentive surface, the latent toned image is then transferred to a support substrate such as paper.

During runtime, the charge levels on the charge-retentive surface 105 are sensed by one or more non-contact voltage sensing devices 133, 143, 153 and 163, which take readings in the inter-page zone between successive images formed by each image forming station 130, 140 150 and 160 with both AC and DC charge devices for each image forming station running at their nominal set points. In various exemplary embodiments, the non-contact voltage sensing devices are non-contact electrostatic voltmeters. Differences between the readings of one or more of the voltage sensing devices 133, 143, 153 and 163 and the corresponding desired target voltages stored in memory for each of the pairs of the DC/AC charging devices 131/132, 141/142, 151/152 and 161/162 result in adjustments to the gird voltages of one or more of the AC charging devices 132, 142, 152 and 162.

Because the ability of the DC charging devices 131, 141, 151 and 161 to charge the charge-retentive surface 105 is based on physical parameters within these charging devices 131, 141, 151, and 161, is time dependent, and is specific to each of these charging devices 131, 141, 151 and 161, in-situ measurements isolating the DC charge for each DC charging device 131, 141, 151 and 161, are desirable to accurately maintain the charge levels.

Figure 2:
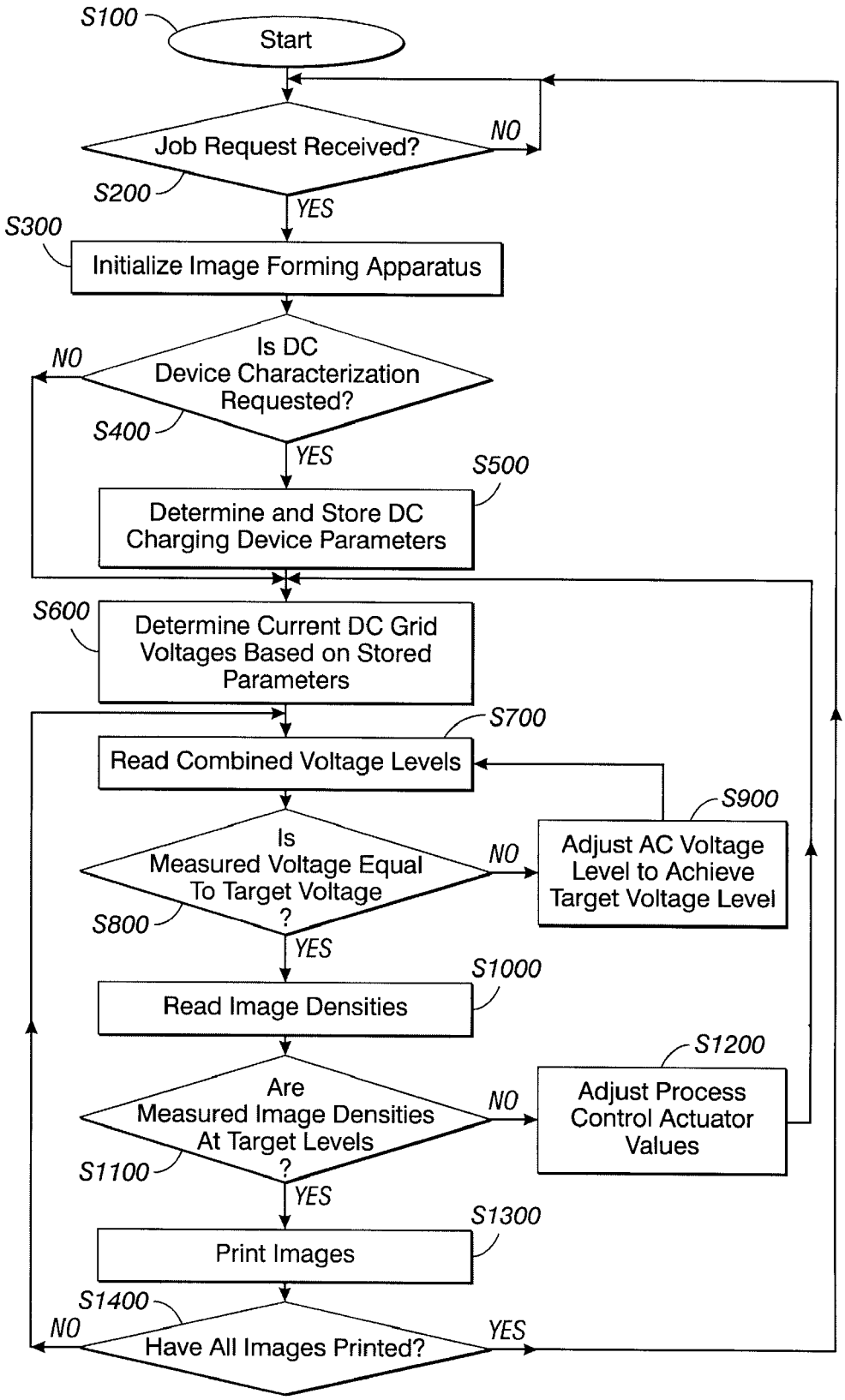
FIG. 2 is a flowchart outlining one exemplary embodiment of a method for setting grid voltage levels in a dual charging system according to this invention.

FIG. 2 is a flowchart outlining one exemplary embodiment of a method for setting charge voltages in a dual charging system according to this invention. The method begins in step S100, and continues to step S200, where a determination is made whether an image forming job request has been received. If an image forming job request has been received, operation proceeds to step S300. Otherwise, operation returns to step S200. In step S300, the image forming apparatus is initialized in response to the received request. Operation then continues to step S400.

In step S400, a determination is made whether DC device characterization has been requested. The request for DC device characterization may be initiated by the user of the image forming device. Alternatively, the request for DC device characterization may be initiated by a process control algorithm. In various exemplary embodiments, a process control algorithm may request DC device characterization based on time elapsed and/or number of image forming operations performed since a previous request. In various other exemplary embodiments, a process control algorithm may request DC device characterization based on one or more current actuator or sensor values.

Next, in step S500, the DC charge device parameters are determined for each DC charging device and are stored in memory. Then, in step S600, the current DC grid voltages to be used during the current job are determined based on the stored DC parameters and various process control variables. The parameters obtained in step S500 are re-used in step S600 unless they have been changed in response to a new request for DC device characterization. Next, in step S7 the combined charge level resulting from the AC and DC charging device pair for each image forming station is read during the current image forming job. Operation then continues to step S800.

In step S800, a determination is made whether the measured charge levels are equal to the target voltages stored in memory. If the measured charges are equal to the target voltages stored in memory, or are within a tolerable limit, operation jumps to step S1000. Otherwise, operation continues to step SS900. In step S900, the AC voltage levels are adjusted to achieve the target voltages. Operation then returns to step S700, where the combined voltage levels are again read. In step S1000, the image density of the requested image is read. Then, in step S1100, a determination is made whether the measured image densities are at the target levels If the image levels are not at the target levels, operation proceeds to step S1200. Otherwise, operation jumps to step S1300.

In step S1200, the process control actuator values are adjusted to change the target voltage values. Operation then returns to step S600. In contrast, in step S1300, the images are transferred from the charge-retentive surface to an output medium, such as paper. Next, in step S1400, a determination is made whether all images have been printed. If not, operation returns to step S700. Otherwise, operation returns to step S200. It should be appreciated that, in various exemplary embodiments, after step S900, the voltages are re-read and the method cycles between steps S700 and S800 until a determination is made in step S800 that the target and actual voltages are equal, which can include using a tolerance factor around the target voltage.

Figure 3:
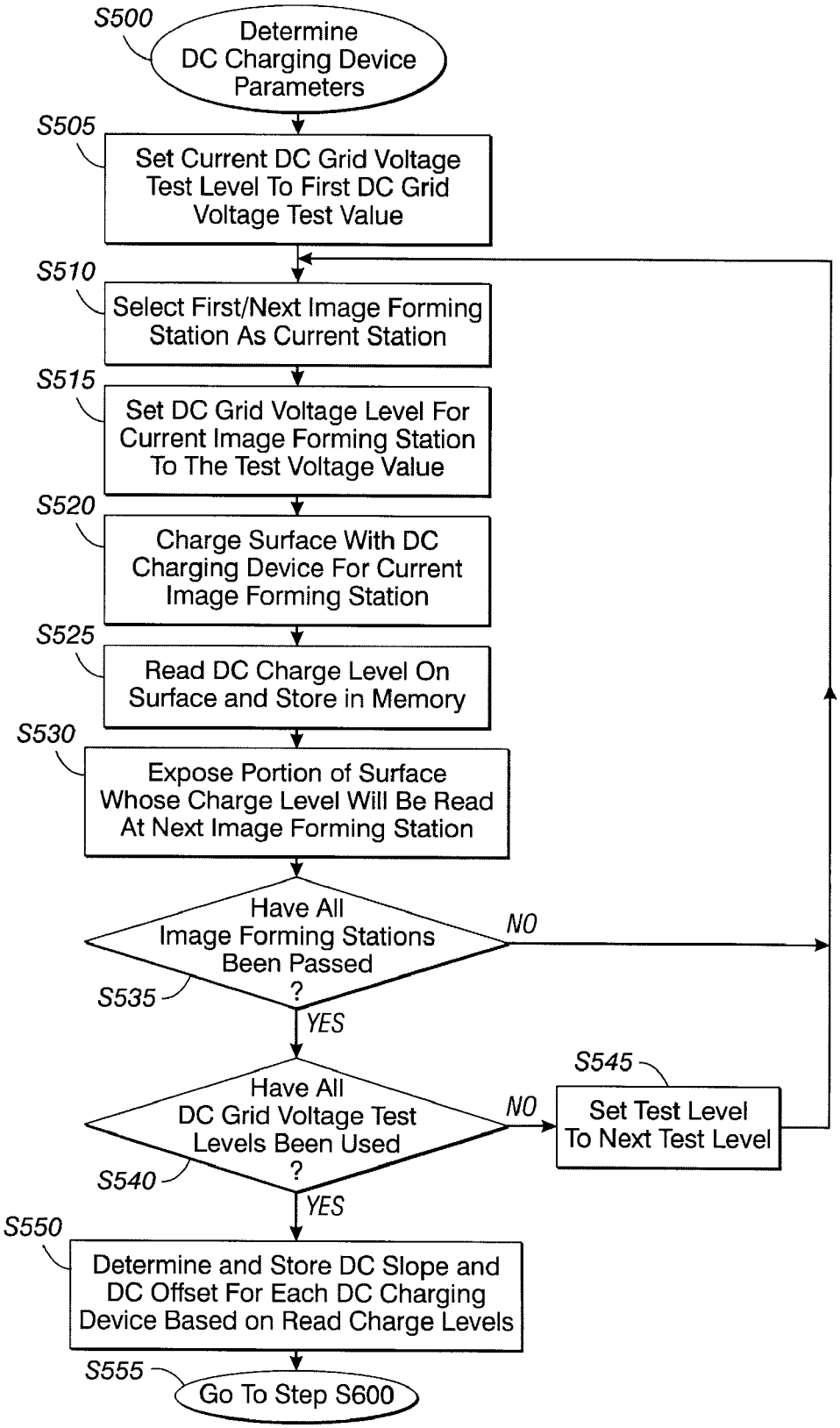
FIG. 3 is a flowchart outlining in greater detail one exemplary embodiment of the step for determining the DC characteristics of an image forming device of FIG. 2.

FIG. 3 is a flowchart outlining in greater detail one exemplary embodiment of a method for determining the DC charging device parameters for each DC charging device of each image forming station in step S700 of FIG. 2. [As show in FIG. 3, operation of the method begins in step S500 and continues to step S505, where the current DC grid voltage test level is set to a first voltage value. Next, in step S510, the first or next image forming station is selected as the current image forming station. Then, in step S515, the DC grid voltage level for the current image forming station is set to the first DC grid voltage test value. Operation then continues to step S520.

In step S520, the charge-retentive surface is charged to a current charge level based on the DC grid voltage of the DC charging device of the current image forming station being set to the current test DC grid voltage. Then, in step S525, the DC charge level on the charge-retentive surface is read using the voltage sensing device of the current image forming station and the read charge value is stored in memory. Next, in step S530, the exposure device for the current image forming station exposes a portion of the charge-retentive surface that will be read by the voltage sensing device of the next image forming station. Operation then continues to step S535.

In step S535, a determination is made whether all image forming stations have been passed. If so, operation proceeds to step S540. Otherwise, operation returns to step 510, where the next image forming station is selected as the current image forming station. In step S540, a determination is made whether all DC grid voltage test values have been used. In various exemplary embodiments, three test values are used. However, it should be appreciated that it may be desirable for more or less than three test values to be used. If, in step S540, it is determined that all DC grid voltage test values have been used, operation proceeds to step S550. Otherwise, the current DC grid voltage is set to the next test voltage value, and operation again returns to step S510.

In step S550, the stored sensed or read charge levels for the various image forming stations are used to determine the DC charging device parameters for each DC charging device at each image forming station. In various exemplary embodiments, a linear fitting technique, such as a linear least squares fitting technique, is used with the measured charge levels obtained for each DC charging device at each image forming station for each test voltage level. However, it should be appreciated that various other data fitting techniques may be used to determine the DC charging device parameters based on the measured charge levels without departing from the spirit or scope of this invention. In step S550, the machine and charging device specific DC slope and DC offset voltage are determined and stored for each DC charging device. Operation then proceeds to step S555, where operation of the method returns to step S600.

Figure 4:
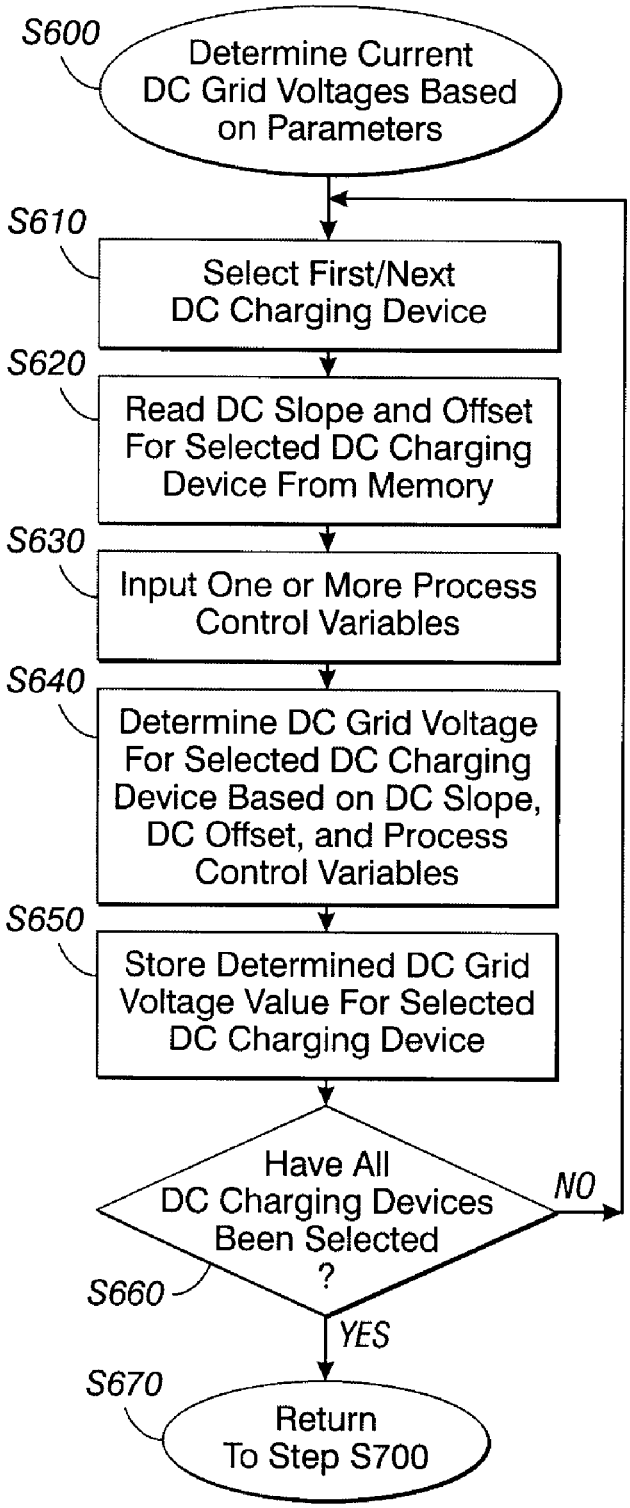
FIG. 4 is flowchart outlining in greater detail an exemplary embodiment of the step of determining the DC grid voltages of FIG. 2.

FIG. 4 is a flowchart outlining in greater detail one exemplary embodiment of a method for determining the current DC grid voltage for each voltage device in step S600 of FIG. 2. Operation of the method begins in step S600, and continues to step S610, where the first or next DC charging device is selected. Then, in step S620, the DC slope and DC offset determined in step S500 of FIG. 2 are read from memory. Next, in step S630, one or more process control variables are input. Next, in step S640, the DC grid voltage for the selected DC charging device that will obtain a desired charge on the charge-retentive surface is determined based on the DC slope and DC offset voltage for that DC charging device and the one or more input process control variables. Operation then continues to step S650.

In step S650, the DC grid voltage usable to obtain a desired charge on the charge-retentive surface determined in step S640 is stored. Then, at step S660, a determination is made whether all DC charging devices have been selected. If all DC charging devices have been selected, operation proceeds to step S870. Otherwise, processing returns to step S610, where the next DC charging device is selected. In contrast, in step S870, operation returns to step S700. Thus, during normal operation, the DC grid voltages of the various image forming stations are set to the DC grid voltages determined at run-time and stored in memory. During runtime, while both the AC and DC charging devices are operating, the voltage sensing device at each image forming takes readings of the charge levels of the charge-retentive surface. If there are differences between the readings and the target voltages stored in memory, the AC charge devices are adjusted to maintain the target voltages.

Figure 5:
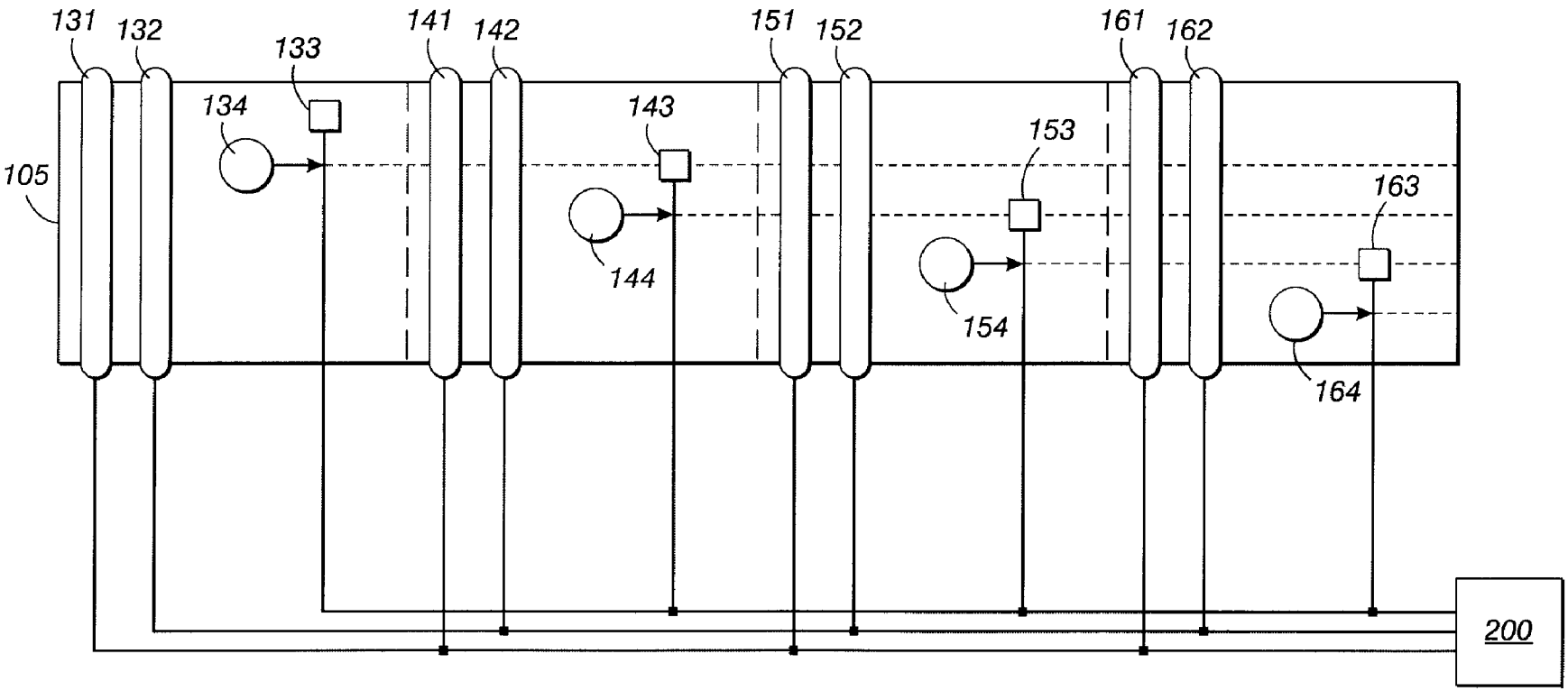
FIG. 5 is a plan view of one exemplary embodiment of the charge-retentive surface and dual charging systems of FIG. 1.

FIG. 5 is a plan view of one exemplary embodiment of the charge-retentive surface and dual charging systems of FIG. 1 used in determining the DC charging device parameters and calculating the DC slope and DC offset for each DC charging device. In FIG. 5, the charge-retentive surface 105 is advanced to the first image forming station 130 charged at a residual voltage level. The DC charging device 131 charges the charge-retentive surface 105 based on the first DC grid voltage test value. Each AC charging device 132, 142, 152 and 162 is powered off while the DC charging device parameters are determined.

Next, the voltage sensing device 133 of the first image forming station 130 measures the charge on the charge-retentive surface 105 and outputs this measured charge value to the system controller 200. The exposure device 134 for the first charging station 130 exposes a portion of the charge-retentive surface 105 which is to be measured by the voltage sensing device 143 of the next charging station 140 by discharging the portion of the charge-retentive surface.

The charge-retentive surface 105 then proceeds to the second image forming color station 140, where the DC charging device 141 recharges the entire charge-retentive surface based on the first DC grid voltage test value. The voltage sensing device 143 for the second image forming station 140 measures the charge level on the charge-retentive surface 105 at the portion of the charge-retentive surface 105 that was exposed by the previous exposure device 134 and outputs the measured charge value to the system controller 200. After the charge level is measured, the exposure device 144 for the second image forming station 140 exposes a portion of the charge-retentive surface 105 which will be measured by the voltage sensing device 153 of the next image forming station 150.

The charge-retentive surface 105 advances to the third image forming station 150, where the DC charging device 151 charges the charge-retentive surface 105 based on the first DC grid voltage test value. The charge level at the location developed by the previous exposure device 144 of the second image forming station 140 is measure by the voltage sensing device 153 of the third image forming station 150 and output by the voltage sensing device 153 to the system controller 200. Next, the exposure device 154 for the third image forming station 150 exposes a portion of the charge-retentive surface to be measured by the voltage sensing device 163 of the fourth image forming station 160.

The charge-retentive surface 105 then advances to the fourth image forming station 160, where the DC charging device 161 charges the charge-retentive surface 105 based on the first DC grid voltage test value. The voltage sensing device 163 of the fourth charging station 160 measures the charge level at the location exposed by the exposure device 154 of the third charging station 150 and outputs the measured charge value to the system controller 200. When all four charging stations 130, 140, 150 and 160 have completed the read-expose-discharge process, the process outlined above is repeated for other desired DC grid voltage test value. In various exemplary embodiments, three DC grid voltage test values are used to obtain the data points for each of the image forming stations 130, 140, 150 and 160. However, it should be appreciated that the systems and methods of this invention may be used with more or fewer DC grid voltage test values without departing from the spirit or scope of this invention.

Figure 6:
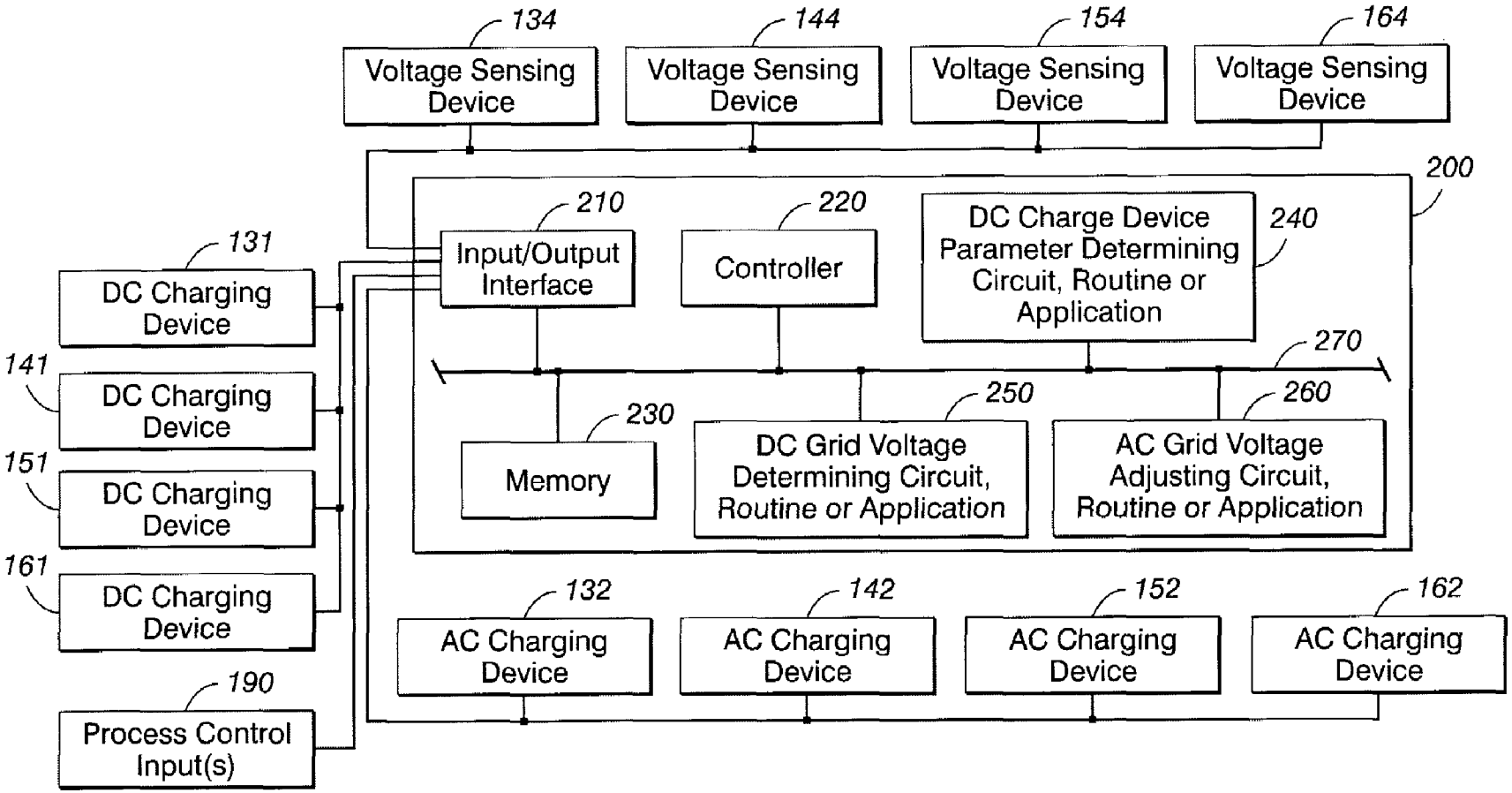
FIG. 6; is a block diagram of one exemplary embodiment of an in situ system and method for setting the charge voltages in a split recharge system according to this invention.

FIG. 6 is a block diagram of one exemplary embodiment of a parameters determining system 200 usable to determine the charging device parameters and to determine the DC and AC (or DC/DC or AC/AC) grid voltages in a split recharge system according to this invention. As shown in FIG. 6, the parameters determining system 200 includes an input/output interface 210, a controller 220, a memory 230, a charge device parameter determining circuit, routine or application 240, a first grid voltage determining circuit, routine, or application 250, and a second grid voltage adjusting circuit, routine or application 260, interconnected by one or more control and/or data busses and/or application program interfaces 270. As shown in FIG. 6, the DC charging devices 131, 141, 151 and 161, the AC charging devices 132, 142, 152, and 162, the voltage sensing devices 134, 144, 154 and 164 and the process control value source 190 are connected to the input/output interface 210.

As shown in FIG. 6, the parameters determining system 200 is, in various exemplary embodiments, implemented using a programmed general purpose computer. However, the parameters determining system 200 can also be implemented using a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 2–4, can be used to implement the parameters determining system 200.

As shown in FIG. 6, the memory 230 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

It should be understood that each of the various circuits, routines or applications 240, 250 and 260 shown in FIG. 6 can be implemented as portions of a suitably programmed general purpose computer. Alternatively, each of the circuits, routines or applications shown in FIG. 6 can be implemented as physically distinct hardware circuits within an ASIC, or using a FPGA, a PLD, a PLA or a PAL, or using discrete logic elements or discrete circuit elements. Alternatively, each of the circuits, routines or applications shown in FIG. 6 can be implemented as individual objects, routine, subroutines or the like stored in the memory 230 in the parameters determining system 200. The particular form each of the circuits, routines or applications shown in FIG. 6 will take is a design choice and will be obvious and predicable to those skilled in the art.

When the parameters determining system 200 is initialized, upon request for an image forming job to be complete, a counter stored in memory 230 is incremented. The controller 220 then determines the whether the current counter value is equal to a table of counter values stored in memory 230. The table of values represents points in the life of the image forming device at which the parameters determining system 200 is to determine the parameters of the image forming device. If the processor 220 determines that the counter is equal to the current table value, a pointer is incremented in the table so that the next table value becomes the current table value. Then, the DC charge device parameter determining circuit, routine or application 240 is invoked. The parameters determining system 200 may also be initialized in response to a request being input by an operator of the image forming device. Alternatively, the parameters determining system 200 may be initialized during an image forming job in response to a process control input.

As shown in FIG. 6, the charge device parameter determining circuit, routine or application 240 gathers voltage readings from each the voltage sensing devices 134, 144, 154 and 164 at one or more test voltage levels. The charge device parameter determining circuit, routine or application 240 sends a first signal to each of the DC charging devices 131, 141, 151 and 161 through the input/output interface 210 to cause the grids of the charging devices 131, 141, 151 and 161 to be set to a first test voltage. As the charge-retentive surface is advanced past each image forming station, the charge parameter determining circuit, routine or application 240 causes measurements to be taken by each voltage sensing device 134, 144, 154 and 164 at each image forming station and for the measurements to be sent to the memory 230 through the input/output interface 210.

Once charge measurements have been taken and stored in memory for each DC charging device 131, 141, 151 and 161, the charge device parameter determining circuit, routine or application 240 sends one or more additional signals causing voltage measurements to made for one or more additional test voltage levels. For each test voltage level, voltage measurements are made for each DC charging device and are sent to and stored in the memory 230. In determining the parameters of the DC charging devices 131, 141, 151 and 161, the charge-retentive surface passes through the image forming stations containing the DC charging devices 131, 141, 151 and 161. For example, when the charge-retentive surface enters the first image forming station containing the first DC charging device 131, under the instruction of the parameters determining system 200, the grid of the first DC charging device 131 is charged to a first grid test value. As the charge-retentive surface passes by the first DC charging device 131, the charging device 131 charges the charge-retentive surface to a charge level approximately correlated to the first grid test value. The voltage sensing device 134 of the first image forming station then reads the charge level on the charge-retentive surface and sends the read value to the memory 230 through the input/output interface 210 and the system bus 270.

Once voltage measurements have been made and stored in the memory 230 for each DC charging device 131, 141, 151 and 161 at each test voltage value set by the charge parameter determining circuit, routine or application 240, the charge device parameter determining circuit, routine or application 240 inputs the measurements from memory to determine parameters for each DC charging device based on those measurements. In various exemplary embodiments, the parameters are determined by the charge parameter determining circuit, routine, or application 240 using a least squares fit technique. In various exemplary embodiments, the determined parameters include the slope and the offset for each DC charging device 131, 141, 151 and 161. These values are then stored by the charge device parameter determining circuit, routine or application 240 in the memory 230. These values will remain in memory 230 until updated during subsequent operation of the charge device parameter determining circuit, routine or application 240.

Once the charge device parameter determining circuit, routine or application 240 has determined the charge device parameters for each DC charging device, the first grid voltage determining circuit, routine or application 250, under control of the controller 220, determines the grid operating voltage for each DC charging device. The first grid voltage determining circuit, routine or application 250 inputs the parameters stored in memory for each DC charging device 131, 141, 151 and 161, and uses those parameters, along with one or more process control values received from the process control value source 190 received by the I/O interface 210 to determine the operating voltage to used during image formation. In various exemplary embodiments, the first grid voltage determining circuit, routine or application 250 determines the grid voltage by subtracting the offset and split voltages from the target voltage and diving the result by the slope. The slope and offset are read from memory while the target voltage and split voltages are determined by processes external to the parameters determining system 200 and supplied to the parameters determining system 200 by the process control value source 190. Thus, the first grid voltage determining circuit, routine or application 250 determines a grid voltage for each DC charging device to be used during image formation. Each subsequent image formation operation causes the first grid voltage determining circuit, routine or application 250 to recalculate the grid voltage based on the stored output of the DC charge device parameter determining circuit, routine or application 240 and the process control values received from the process control values source 190.

During image formation, the controller 220 sends a signal through the input/output interface 220 causing each DC charging device 131, 141, 151 and 161 to operate at its respective grid voltage level that is stored in the memory 230. Also, during image formation, the parameters determining system 200 maintains electrostatic control of the image forming apparatus by sending control signals which cause the voltage sensing devices 134, 144, 154 and 164 at each image forming station to take voltage measurements of the combined voltage level on the charge-retentive surface. The second grid voltage adjusting circuit, routine or application 260 causes these values to be measured and sent from the voltage sensing devices 134, 144, 154 and 164 to the memory 230.

The second grid voltage adjusting circuit, routine or application 260 then determines if there is a difference between the target voltage level and the measured voltage level for each image forming station. In various exemplary embodiments, the second grid voltage adjusting circuit, routine or application 260 makes this determination by determining the absolute value of the difference between the measured values and the target voltages stored in the memory 220 by the first grid voltage determining circuit, routine or application 250 for each DC charging device. If the absolute value of the difference between the measured values and the target values is larger than a given tolerance, the second grid voltage adjusting circuit, routine or application 260 determines a new grid voltage level sufficient to achieve the target voltage level on the charge-retentive surface and sends a signal to each AC charging device to cause the charging device to be set to the new voltage level. Accordingly, the desired split voltage between the AC charging devices 132, 142, 152 and 162 and the DC charging devices 131, 141, 151 and 161 can be maintained while the target voltage on the charge-retentive surface is achieved.

It should be appreciated that, while the above-outlined descriptions of various exemplary embodiments specifically refer to DC and AC charging devices and that the first and second grid voltage adjusting circuits, routines, or applications are respectively associated with the DC and AC charging devices, the first and second grid voltages adjusting circuits can also adjust the grid voltages for DC/DC charging devices or AC/AC charging devices.

While particular embodiments have been described, alternatives, modifications, variations, improvements, and substantial equivalents, whether known or that are or may be presently unforeseen, may become apparent to applicants or others skilled in the art. Accordingly, the exemplary embodiments of the invention, as set forth above, are intended to be illustrative, not limiting. Various changes may be made without departing from the spirit and scope of the invention. Therefore, the appended claims as filed and as they may be amended are intended to embrace all known or later-developed alternatives, modifications variations, improvements, and substantial equivalents.

What is claimed is:

1. A method for measuring and setting grid voltages in an image forming device comprising:

setting a first charging device of a first image forming station to a first voltage level and setting a second charging device of the first image forming station to be off;

charging a charge-retentive surface with the first charging device set at the first voltage level;

measuring the charge imparted to the charge-retentive surface by the first charging device;

storing the measured charge value;

repeating the setting, charging, measuring and storing steps for the first charging device for at least one additional voltage level; and determining at least one parameter of the first charging device based on the stored measured charge values for the first charging device for each voltage level.

2. The method according to claim 1, further comprising:
repeating the setting, charging, measuring, storing and determining steps for at least one additional first charging device at a second image forming station.

3. The method according to claim 2, further comprising:
before advancing the charge-retentive surface to another image forming station, discharging a portion of the charge-retentive surface, which was charged during the charging step for the charging device of the previous image forming station, that will be measured at the next image forming station; and
advancing the charge-retentive surface to the next image forming station.

4. The method according to claim 3, further comprising:
determining an operating grid voltage for each first charging device based on the at least one parameter; and
determining a combined target voltage level to be imparted on the charge-retentive surface by each image forming station during image formation.

5. The method according to claim 1, wherein determining at least one parameter comprises determining at least one of an operating slope and an offset value for each first charging device of each image forming station.

6. The method according to claim 5, wherein determining at least one of the operating slope and the offset value for each first charging device comprises determining at least one of the operating slope and the offset value for each first charging device by performing linear data fitting on the measured charge values.

7. The method according to claim 3, further comprising:
setting each first charging device to its operating grid voltage level during image formation;
setting each second charging device to be off;
measuring the charge level imparted on the charge-retentive surface at each image forming station; and
adjusting a voltage level of the second charging device at each image forming station when the measured charge level on the charge-retentive surface differs from the target voltage level for that image forming station by more than a predetermined amount.

8. The method according to claim 1, wherein setting the first charging device to the first voltage comprises setting a DC charging device to the first voltage.

9. The method according to claim 8, wherein setting the second charging device to be off comprise setting an AC charging device to be off.

10. The method according to claim 8, wherein setting the second charging device to be off comprises setting a DC charging device to be off.

11. The method according to claim 1, wherein setting the first charging device to the first voltage comprises setting an AC charging device to the first voltage.

12. The method according to claim 11, wherein setting the second charging device to be off comprises setting an AC charging device to be off.

13. The method according to claim 11, wherein setting the second charging device to be off comprises setting a DC charging device to be off.

14. A method for measuring and setting DC grid voltages in an image forming device, comprising:
setting a first DC charging device at a first image forming station to a first voltage level and setting an AC charging device at the first image forming station to be off;
charging a charge-retentive surface with the first charging device set at the first voltage level;
measuring the charge imparted to the charge-retentive surface by the first charging device;
storing the measured charge value;
repeating the setting, charging, measuring and storing steps for the first DC charging device for at least one additional voltage level; and
determining at least one parameter of the first DC charging device based on the stored measured charge values for the first charging device.

15. The method according to claim 14, wherein determining at least one parameter comprises determining at least one of a DC operating slope and a DC offset value for each DC charging device of each image forming station.

16. The method according to claim 15, wherein determining at least one of the DC operating slope and the DC offset value for each DC charging device comprises determining at least one of the DC operating slope and the DC offset value for each DC charging device by performing linear data fitting on the measured charge values.

17. The method according to claim 16, further comprising:
repeating the setting, charging, measuring, storing and determining steps for at least one additional DC charging device at a next image forming station.

18. The method according to claim 15, further comprising:
discharging a portion of the charge-retentive surface, which was charged during the charging step for the charging device of the previous image forming station, that will be measured at the next image forming station; and
advancing the charge-retentive surface to the next image forming station.

19. The method of claim 16, further comprising:
determining a DC operating grid voltage for each DC charging device based the at least one parameter; and
determining a combined target voltage level to be imparted on the charge-retentive surface by each image forming station during image formation.

20. The method of claim 19, further comprising:
setting each DC charging device to its DC operating grid voltage level during image formation;
measuring the charge level imparted on the charge-retentive surface at each image forming station; and
adjusting a voltage level of the AC charging device at an image forming station when the measured charge level on the charge-retentive surface differs from the target voltage level for that image forming station by more than a predetermined amount.

21. A method for determining operating voltages in a split recharge image forming system having a plurality of image forming stations, each station having a DC charging device and an AC charging device, the method comprising:
determining a combined target voltage level to be imparted on a charge-retentive surface during image formation by each DC charging device and AC charging device in combination, based on at least a determined DC grid operating voltage, and at least one determined DC parameter;
measuring, for each image forming station, the charge imparted on the charge-retentive surface during image formation by the DC charging device and the AC charging device of that image forming station;
determining, for each image forming station, if the measured charge differs from the target voltage level by more than a determined amount;
adjusting, for each image forming station that has a measured charge that differs from the target voltage level by more than the determined amount, the charge level of the AC charging device for that image forming station.

22. A charge parameter determining system usable to measure and set operating voltages in a split recharge image forming apparatus that has a plurality of image forming stations, each image forming station having a first charging device and a second charging device, a voltage sensing device and an exposure device, the system comprising:

a charge device parameter determining circuit, routine or application that determines at least one charge device parameter of each first charging device;

a grid voltage determining circuit, routine or application that determines at least one grid voltage for each first charging device and a combined target voltage level; and a voltage adjusting circuit, routine or application which adjusts the grid voltage level of the second charging device to maintain the target voltage level at each image forming station.

23. The charge parameter determining system of claim 22, wherein the charge device parameter determining circuit, routine or application determines one of a slope and an offset for each first charging device based on charge levels measured by each voltage sensing device corresponding to a plurality of charge levels.

24. The charge parameter determining system of claim 22, wherein the grid voltage determining circuit, routine or application determines a grid voltage level for operating the each first charging device during image formation and a combined target voltage level based on at least one of the slope and the offset of each first charging device and at least one process control input.

25. The charge parameter determining system of claim 24, wherein the grid voltage adjusting circuit, routine or application adjusts the grid voltage level of each second charging device during runtime to achieve the target voltage levels on the charge-retentive surface during image formation in response to variations between measured voltage levels and the target voltage levels which exceed a determined value.

26. A computer-readable storage medium containing instructions for measuring and setting grid voltages in an image forming device, comprising:

instructions for setting a first charging device of a first image forming station to a first voltage level and setting a second charging device of the first image forming station to be off;

instructions for charging a charge-retentive surface with the first charging device set at the first voltage level;

instructions for measuring the charge imparted to the charge-retentive surface by the first charging device;

instructions for storing the measured charge value;

instructions for repeating the setting, charging, measuring and storing steps for the first charging device for at least one additional voltage level; and instructions for determining at least one parameter of the first charging device based on the stored measured charge values for the first charging device for each voltage level.

27. The computer-readable storage medium of claim 26, further comprising instructions for repeating the setting, charging, measuring, storing and determining steps for at least one additional first charging device at a next image forming station.

28. The computer-readable storage medium of claim 27, further comprising:

instructions for discharging a portion of the charge-retentive surface, which was charged during the charging step for the charging device of the previous image forming station, that will be measured at the next image forming station, before advancing the charge-retentive surface to another image forming station; and instructions for advancing the charge-retentive surface to the next image forming station.

29. The computer-readable storage medium of claim 27, further comprising:

instructions for determining an operating grid voltage for each first charging device of each charging device pair based on the at least one parameter; and instructions for determining a combined target voltage level to be imparted on the charge-retentive surface by each image forming station during image formation.

30. The computer-readable storage medium of claim 26, wherein the instructions for determining at least one parameter comprises instructions for determining at least one of an operating slope and an offset value for each first charging device of each image forming station.

31. The computer-readable storage medium of claim 30, wherein the instructions for determining at least one of the operating slope and the offset value for each first charging device comprises instructions for determining at least one of the operating slope and the offset value for each first charging device by performing linear data fitting on the measured charge values.

32. The computer-readable storage medium of claim 27, further comprising:

instructions for setting each first charging device of each charging device pair to its operating grid voltage level during image formation;

instructions for measuring the charge level imparted on the charge-retentive surface at each image forming station; and instructions for adjusting a voltage level of a second charging device of each charging device pair at an image forming station when the measured charge level on the charge-retentive surface differs from the target voltage level for that image forming station by more than a predetermined amount.

33. The computer-readable storage medium of claim 26, wherein the instructions for setting a first charging device of a first image forming station to the first voltage level comprising instructions for setting a DC charging device to the first voltage level.

34. The computer-readable storage medium of claim 33, the instructions for setting a second charging device of the first image forming station to be off comprising instructions for setting an AC charging device to be off.

35. The computer-readable storage medium of claim 33, the instructions for setting a second charging device of the first image forming station to be off comprising instructions for setting an DC charging device to be off.

36. The computer-readable storage medium of claim 26, wherein the instructions for setting a first charging device of a first image forming station to the first voltage level comprising instructions for setting an AC charging device to the first voltage level.

37. The computer-readable storage medium of claim 36, the instructions for setting a second charging device of the first image forming station to be off comprising instructions for setting an AC charging device to be off.

38. The computer-readable storage medium of claim 36, the instructions for setting a second charging device of the first image forming station to be off comprising instructions for setting an DC charging device to be off.

* * * * *